United States Patent [19]

Hamano

[11] 3,986,296

[45] Oct. 19, 1976

[54] TOY RACE TYPE GAME EMPLOYING A FLEXIBLE BELT MAGNETICALLY COUPLED WITH AT LEAST ONE MOVABLE BODY

[75] Inventor: Nobuo Hamano, Tokyo, Japan

[73] Assignee: Tomy Kogyo Co., Inc., Tokyo, Japan

[22] Filed: June 13, 1975

[21] Appl. No.: 586,555

[30] Foreign Application Priority Data

June 28, 1974 Japan ..... 49-76094

[52] U.S. Cl. ..... 46/240; 273/86 B

[51] Int. Cl.[2] ..... A63H 18/14

[58] Field of Search ..... 273/86 B, 86 F; 46/202, 46/206, 239, 240

[56] References Cited

UNITED STATES PATENTS

| | | | |
|---|---|---|---|
| 2,551,806 | 5/1951 | McKeever | 273/86 B |
| 3,103,360 | 9/1963 | Miller et al. | 273/86 B |
| 3,212,776 | 10/1965 | Bassler | 272/73 |
| 3,744,795 | 7/1973 | Lipscomb | 273/86 B |

FOREIGN PATENTS OR APPLICATIONS

| | | | |
|---|---|---|---|
| 809,539 | 4/1969 | Canada | 273/86 B |

*Primary Examiner*—Anton O. Oechsle
*Attorney, Agent, or Firm*—Edward D. O'Brian

[57] ABSTRACT

A toy race type game employing magnetic coupling can be constructed utilizing a non-ferromagnetic support serving to hold one or more bodies serving as game elements in such a manner that such bodies may be moved relative to the upper surface of the support. A drive means is provided for moving an actuator carrying a holder beneath such support in such a manner that the holder is moved adjacent to the lower surface of the support. Magnetic members are provided on the body and the holder for magnetically coupling the bodies to the holder so that these bodies are moved relative to the surface of the support as the drive means are actuated. The actuator used comprises an endless, flexible belt which is located beneath the support and which is held so that along part of its length it is capable of flexing so as to follow a non-uniform path as the drive means is operated. Preferably the holder consists of a rotatable disk mounted on the belt. Internal track means may be provided so as to periodically engage the periphery of the disk as the belt is moved so as to cause the disk to rotate. Such rotation causes a variation in the location and movement of the bodies and the support as a result of the magnetic coupling.

6 Claims, 3 Drawing Figures

TOY RACE TYPE GAME EMPLOYING A FLEXIBLE BELT MAGNETICALLY COUPLED WITH AT LEAST ONE MOVABLE BODY

REFERENCE TO RELATED PATENTS

Robins U.S. Pat. No. 2,548,495, issued Apr. 10, 1951, entitled "MAGNETIC RACING GAME DEVICE"; Baca U.S. Pat. No. 2,918,284, issued Dec. 22, 1959, entitled "AMUSEMENT DEVICE"; Miller, et al. U.S. Pat. No. 3,103,360, issued Sept. 10, 1963, entitled "ELECTRICAL RACING DEVICE"; Warren U.S. Pat. No. 3,326,555, issued June 20, 1967, entitled "TOY RACING GAME WITH ROTATING ARM AND SEPARATE SUB-ROTOR DRIVE"; Warren U.S. Pat. No. 3,336,695, issued Aug. 22, 1967, entitled "TOY AUTOMOBILE RACE DEVICE WITH ROLL-OVER RAMP"; Shaw U.S. Pat. No. 3,532,341, issued Oct. 6, 1970, entitled "RACING GAME WITH MAGNETICALLY DRIVEN RACING ELEMENTS"; Brown U.S. Pat. No. 3,722,884, issued Mar. 27, 1973, entitled "FRONTALLY RAISEABLE VEHICLES AMUSEMENT APPARATUS"; Ochi, et al. U.S. Pat. No. 3,823,941, issued July 16, 1974, entitled "DIVERSIFIED MOTION DEVICE IN A STEERING GAME AMUSEMENT MACHINE"; British patent specification No. 1,210,577, published Oct. 28, 1970, entitled "RACING GAME".

BACKGROUND OF THE INVENTION

The invention set forth in this specification pertains to a new and improved toy race type game employing magnetic coupling in such a manner as to move one or more bodies serving as game elements across the upper surface of a support.

It is well known to construct toy race type games so as to utilize a movable actuator to move one or more magnets beneath the surface of a support and to magnetically couple such magnets with one or more bodies serving as game elements located on the surface of the support. Toys of this general type are commonly constructed so that such bodies appear as simulated vehicles, motorcycles and the like. Within toys of this type it is conventional to utilize an electric motor to turn an actuator consisting of a disk or rotor or an actuator consisting of an arm-type structure serving to support the magnets used.

Although toys constructed as indicated are considered to be effectively desirable for play purposes it has been recognized that such toys tend to have a limitation which effects their play value. This limitation relates to the fact that in such toys the bodies referred to in the preceding are normally moved around essentially a uniform path. This is disadvantageous because children frequently become somewhat bored with seeing bodies as noted move only in one repetitive manner.

The recognition of this is believed to have led to a variety of other known structures in which the magnets located under a support are carried by secondary rotors and/or arms serving as rotors mounted so as to rotate about a vertical axis parallel to the axis of a disk, rotor or arm-type actuator as referred to in the preceding discussion. Although such structures are utilitarian they are not considered to possess as great a play value as is frequently desired because of their uniformity of the action achieved with them.

SUMMARY OF THE INVENTION

A broak objective of the present invention is to provide new and improved toy race-type games of the generalized category indicated in the preceding discussion. A somewhat related objective of the invention is to provide toys as indicated which are exceedingly desirable as toys because of the variation in the manner in which bodies are moved in these toys and because of the random type motion which is involved with the movement of such bodies. Further objectives of the present invention are to provide toy games as indicated which may be easily and conveniently constructed at a comparatively normal cost, which are relatively inexpensive, which are capable of giving prolonged, reliable performance, and which are desirable for play purposes because of their attention getting and holding characteristics.

In accordance with this invention these and various related objectives of it as will be apparent from a detailed consideration of the remainder of this specification are achieved by providing in a toy having a non-ferromagnetic support having upper and lower surfaces, a body located above the upper surface of the support so as to be movable relative to the support, an actuator located beneath the lower surface of the support so as to be movable relative to the support, drive means for moving the actuator, a holder located on the actuator adjacent to the lower surface of the support so as to be capable of being moved as the actuator is moved and magnetic means on the body and the holder for magnetically coupling the body and the holder so that the body is moved during movement of the holder the improvement which comprises: the actuator comprising an endless, flexible belt located beneath the support, the holder being mounted on this belt so as to be capable of being moved as the belt is moved, this belt being unrestrained throughout a portion of its length sufficient so that the unrestrained portion of the belt will flex as a result of the inherent physical properties of the belt so as to follow a non-uniform path as the drive means is operated.

BRIEF DESCRIPTION OF THE DRAWING

The invention is best more fully described with reference to the accompanying drawing in which.

Figure 1:
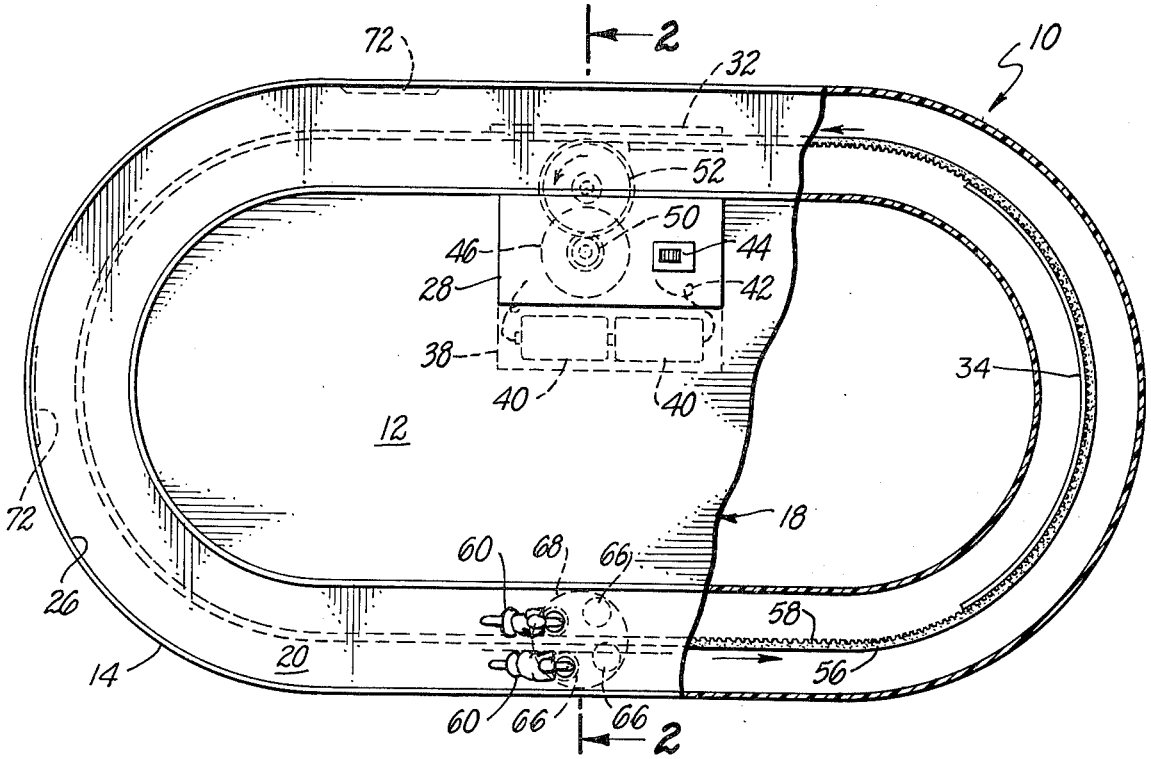
FIG. 1 is a top plan view indicating in a diagrammatic manner the nature of a presently preferred embodiment of a toy game in accordance with this invention, a portion of this view being broken away so as to indicate certain constructional details.
Figure 2:
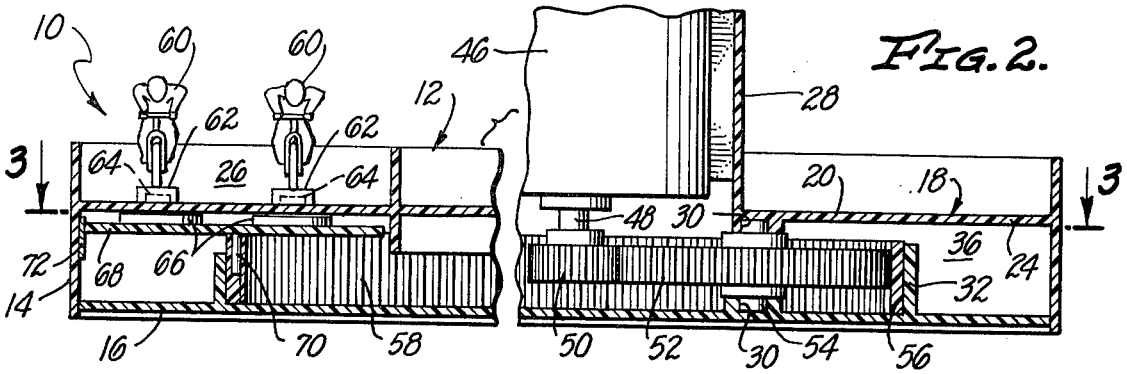
FIG. 2 is a cross-sectional view, partially broken away on an enlarged scale taken at line 2—2 of FIG. 1.
Figure 3:
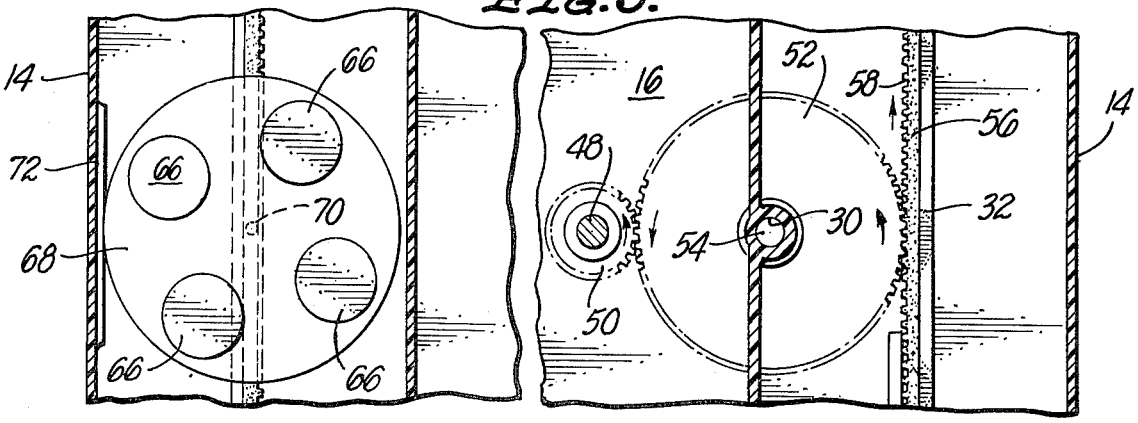
FIG. 3 is a partial cross-sectional view taken at line 3—3 of FIG. 2.

The toy game illustrated in the drawing embodies concepts and/or principles as are set forth and defined in the appended claims forming a part of this specification. It is believed that it will be apparent from the discussion embodied within this specification as well as from a consideration of the drawing that these concepts and/or principles may be utilized in a wide variety of differently appearing and/or somewhat differently constructed toys through the use or exercise of routine design skill in the toy industry.

DETAILED DESCRIPTION

In the drawing there is shown a toy game 10 which includes a housing 12 formed of a non-ferromagnetic material such as a conventional polymer composition. This housing 12 has a continuous side wall 14, connecting a bottom wall 16 and a support or top wall 18. This side wall 14 preferably continues upwardly past the upper surface 20 of the support 18 as illustrated. The housing 12 also includes another wall 22 located upon the support 18 so as to extend both upwardly from the upper surface 20 beneath the lower surface 24 of the support 18. Adjacent to the upper surface 20 this wall 22 "cooperates" with respect to the side wall 14 so as to define what may be referred to as an external "track" 26. The housing 12 also includes a cabinet 28, internal bearings 30 formed on the lower surface 24 of the support 18 and on the bottom wall 16, respectively, and guides 32 and 34. The space beneath the lower surface 24 of the support 18 between the wall 22 and the wall 16 serves as an internal "track" 36 which corresponds in shape to the track 26.

In the game 10 the cabinet 28 is formed so as to include a conventional battery retainer 38 holding batteries 40 which are connected by wires 42 through a switch 44 to a motor 46. This motor 46 is mounted within and upon the cabinet 28 so as to have a vertical drive shaft 48 located a short distance above the bottom wall 16. This shaft 48 carries a small horizontal pinion gear 50 which drives a larger horizontal spur gear 52 carried by a vertical shaft 54 mounted on the bearings 38. The portion of this spur gear 52 diametrically opposite to the pinion gear 50 is located adjacent to and spaced from the guide 32. It is noted also that this spur gear 52 is spaced from the lower surface 24 of the support 18 a sufficient distance so that the internal track 36 is not significantly blocked or filled by this spur gear 52.

This spur gear 52 is used to drive an endless flexible belt 56 formed out of a material such as polypropylene or the like so as to include along its entire interior (not separately numbered) gear teeth 58 corresponding to the teeth of a conventional gear rack. The guide 32 and the spur gear 52 are dimensioned so that these teeth 58 will be held in engagement with the gear 52 by the guide 32 at all times. Preferably this guide 32 is located as shown so that the belt 56 will be engaged by the spur gear 52 approximately mid-way between the wall 14 and the wall 22.

It is believed that it will be apparent from the preceding that the motor 46 is operated that the belt 56 will be advanced within the track 36 so that it will continuously move around the interior of this track 36. Because of the physical characteristics of this belt 56 it will tend to "flex" or bent to a degree as it is moved so that it will not follow a completely uniform path except as it is engaged with the guides 32 and 34. This guide 34 is located along a curved portion of the track 36 so as to stabilize to a degree the motion of the belt 56 as it goes adjacent to this guide 34. A degree of such stabilization is considered desirable so as to achieve with the toy periods of movement of bodies 60 which are of a relatively uniform or expected character together with periods of movement of such bodies 60 which are of a relatively unrestrained, random type of character.

Such bodies 60 are preferably simulated figures such as figures of motorcycles, toy cars, or the like which are provided in their bases 62 with permanent magnets 64.

These magnets 64 are magnetically coupled through the support 18 with other corresponding, normally somewhat larger magnets 66 mounted upon a rotor 68. This rotor 68 is carried by a vertical shaft 70 which in turn is rotatably supported by the belt 56. This rotor 68 is preferably held parallel to and adjacent to the lower surface 24 so as to be closely spaced relative to this lower surface 24 in order to minimize the strengths of the magnets used in order to obtain coupling so that the bodies 60 will move as the rotor 68 is advanced through the movement of the belt 56 as the motor 46 operates.

The rotor 68 is also preferably of slightly less diameter than the distance between the wall 22 and the wall 14 so that at times as, for example, when the belt 56 is supported against the guides 32 and 34 the belt 56 will move in such a manner that the rotor 68 does not contact either the wall 14 or the wall 22. When, however, the motion of the belt 56 is not being restrained by the guides 32 and 34 the rotor 68 will normally engage at periodic, varying locations and intervals the wall 22 or the wall 14.

The friction of such engagement will cause the rotor 68 to turn about the axis of the shaft 70. This in sequence will cause a variation in the magnetic coupling effect achieved with the magnets 64 and 66 of a more or less random manner. This of course will result in the bodies 60 becoming differently oriented and/or moving with respect to one another so that these bodies change in relative position. As a result of this a random action is achieved which is considered to significantly enhance the play value achievable with the type of toy involved here.

If desired at periodic intervals short wall sections 72 of a relatively high friction material such as open-called foam flexible synthetic rubber may be located within the track 36 along either the wall 22 or the wall 14. When such sections 72 are engaged by the rotor 68 rotation of the rotor 68 will be promoted or made more pronounced. If desired the walls 14 and 22 may be coated with continuous coatings (not shown) of such high friction material extending completely around the track 36. This is not normally considered desirable since the friction resulting from the contact of the rotor 68 with uncoated walls will normally cause sufficient rotation of the rotor 68 to achieve apparently unexpected changes in orientation and/or position of the bodies 60.

The game 10 may conveniently be provided with various obvious auxiliary means (not shown) to enhance its play value as the bodies 60 are moved around the track 26 through the action described in the preceding. As an example of this appropriate finishing and starting lines (not shown) corresponding to those on a conventional race course may be indicated on the track 26. Further, known or other types of lap counters (not shown) can be employed to indicate the number of times that the bodies 60 are moved around the track 26. If desired an appropriate switch mechanism (not shown) may be provided to limit the number of times the bodies 60 move around the track 26 after the game 10 is turned on through the actuation of the switch 44. Although normally this game 10 will be used with a plurality of bodies 60 it is to be realized that the game 10 possesses significant play value even when only a single body 60 is used on the track 26.

I claim:

1. In a toy having a non-ferromagnetic support, said support having upper and lower surfaces, a bottom wall located beneath and spaced from said support, a body located above the upper surface of said support so as to be movable relative to said upper surface of said support, an actuator located beneath the lower surface of said support so as to be capable of being moved relative to said support beneath the lower surface of said support, said actuator resting on said bottom wall, drive means for moving said actuator beneath said lower surface of said support, a holder located on said actuator adjacent to the lower surface of said support, said holder being capable of being moved adjacent to the lower surface of said support as said actuator is moved and magnetic means for magnetically coupling said body to said holder located on said body and on said holder, said magnetic means coupling said body to said holder so that said body is moved during movement of said holder and said actuator in which the improvement comprises:

wall means extending between said support and said bottom wall so as to define an internal endless track having sides which are spaced from one another and which are located between said support and said bottom wall, said actuator comprising an endless, flexible belt located within and extending around said track, said belt being less thick than the distance between said sides and said track and having gear teeth formed on an entire surface thereof facing a side of said track, said drive means including a ring gear having a portion of its periphery located within said track between said sides of said track and including means for turning said ring gear, a first guide means for holding gear teeth on said belt in engagement with said portion of said gear so that as said gear is turned said belt will be caused to advance around said track, said first guide means being located within said track and engaging said belt adjacent to said ring gear, said first guide means extending along a part of the length of said track adjacent to said gear, said belt being sufficiently flexible so as to be capable of flexing in a non-uniform path as it is advanced around said track, second guide means for engaging said belt as said belt is advanced around said track so as to control the flexing of the portion of said belt adjacent to said second guide means, said second guide means being located within said track, extending along a part of the length of said track and being spaced from said first guide means, said holder being mounted on a portion of said belt so as to be advanced around said track, said holder being moved in accordance with the flexure of said portion of said belt so as to be moved in a controlled path as said portion of said belt is moved adjacent to said first and said second guide means and so as to be moved in a non-uniform path as the portion of said belt upon which said holder is located is moved between said first and said second guide means, said holder comprising a rotor rotatably mounted on said belt, said rotor being rotatably mounted on said belt so as to extend parallel to said upper surface of said support, said rotor being of less diameter than the distance between the sides of said track, said belt being capable of flexing as it is advanced around said track between said first and second guide means so that said rotor randomly engages the interior of said track defining wall means as said belt flexes so as to be rotated relative to said belt as a result of engagement with the interior of said track means.

2. A toy claimed in claim 1 including:

friction means located on the interior of said track means for engagement with said rotor so as to promote rotation of said rotor.

3. In a toy having a non-ferromagnetic support, said support having upper and lower surfaces, a body located above the upper surface of said support so as to be movable relative to said upper surface of said support, an actuator located beneath the lower surface of said support so as to be capable of being moved relative to said support beneath the lower surface of said support, drive means for moving said actuator beneath said lower surface of said support, a holder located on said actuator adjacent to the lower surface of said support, said holder being capable of being moved adjacent to the lower surface of said support as said actuator is moved and magnetic means for magnetically coupling said body to said holder located on said body and on said holder, said magnetic means coupling said body to said holder so that said body is moved during movement of said holder and said actuator in which the improvement comprises:

wall means beneath said lower surface of said support defining an internal, endless track having sides which are spaced from one another, said actuator comprising an endless, flexible belt located within and extending around said track, said belt being less thick than the distance between said sides, said belt being sufficiently flexible so as to be capable of flexing as it is moved beneath said support around said track in a non-uniform path, said holder comprising a rotor rotatably mounted on said belt so as to extend parallel to said upper surface of said support as said belt is moved beneath said lower surface of said support, said rotor being of less diameter than the distance between said sides of said track and being of sufficient diameter so as to randomly engage said sides of said track defining wall means as said belt flexes as it is moved so as to be rotated relative to said belt as a result of periodic engagement with the interior of said track.

4. A toy as claimed in claim 3 including:

friction means located on the interior of said track defining wall means for engaging said rotor as said belt is moved and flexes so as to promote rotation of said rotor.

5. A toy as claimed in claim 3 including:

guide means for engaging said belt as said belt is moved so as to control the flexing of a portion of said belt as said belt is moved.

6. A toy as claimed in claim 3 including:

friction means located on the interior of said track defining wall means for engaging said rotor as said belt is moved and flexes so as to promote rotation of said rotor, guide means for engaging said belt as said belt is moved so as to control the flexing of a portion of said belt as said belt is moved.

* * * * *